US005437888A

United States Patent [19]

Ortlieb

[11] Patent Number: 5,437,888

[45] Date of Patent: Aug. 1, 1995

[54] METHOD FOR CONTINUOUSLY MANUFACTURING A WATERPROOF ZIP CLOSURE

[76] Inventor: Hartmut Ortlieb, Rehdorfer Str. 5, D-90431 Nurnberg, Germany

[21] Appl. No.: 204,171

[22] PCT Filed: Aug. 17, 1992

[86] PCT No.: PCT/DE92/00688

§ 371 Date: Mar. 3, 1994

§ 102(e) Date: Mar. 3, 1994

[87] PCT Pub. No.: WO93/04605

PCT Pub. Date: Mar. 18, 1993

[30] Foreign Application Priority Data

Sep. 3, 1991 [DE] Germany ..... 41 29 191.3

[51] Int. Cl.[6] ..... B05D 3/12; A44B 19/32

[52] U.S. Cl. ..... 427/172; 24/389; 427/412.1; 427/413

[58] Field of Search ..... 156/66; 24/381, 388, 24/389, 384; 427/284, 172, 412.1, 413

[56] References Cited

U.S. PATENT DOCUMENTS

| | | | |
|---|---|---|---|
| 2,557,827 | 10/1944 | Krupp | 24/389 |
| 3,764,437 | 10/1973 | Heimberger | 156/66 X |
| 3,914,827 | 10/1975 | Brown et al. | 24/389 X |
| 4,112,150 | 9/1978 | Brown et al. . | |
| 4,658,480 | 4/1987 | Morioka | 24/389 |
| 4,724,586 | 2/1988 | Tsubokawa et al. | 24/389 X |
| 4,780,937 | 11/1988 | Kusayama | 24/381 X |
| 4,812,949 | 3/1989 | Heimberger et al. . | |
| 4,817,252 | 4/1989 | Kusayama | 24/381 X |
| 4,888,859 | 12/1989 | Horita | 24/389 |

FOREIGN PATENT DOCUMENTS

| | | |
|---|---|---|
| 161446 | 12/1967 | Germany . |
| 1930444 | 12/1970 | Japan . |
| 1129368 | 11/1965 | United Kingdom . |

*Primary Examiner*—Michael W. Ball
*Assistant Examiner*—David W. Reed
*Attorney, Agent, or Firm*—Peter Jon Gluck; Morris Law Firm; Thomas R. Morrison

[57] ABSTRACT

A waterproof zip closure is formed by extruding a first thermoplastic material onto its teeth, and applying a transverse force while the first thermoplastic material cures. The transverse force is sufficient to move the teeth in the separating direction, but is less than that which can cause separation. After curing of the thermoplastic material, the tapes and teeth of the zip closure are coated with a second thermoplastic sealing material, while the transverse force is maintained. When the transverse force is removed the sealing material is forced together to provide a waterproof seal. The second thermoplastic sealing material on the tapes further improves the waterproof nature of the zip closure.

6 Claims, 1 Drawing Sheet

METHOD FOR CONTINUOUSLY MANUFACTURING A WATERPROOF ZIP CLOSURE

BACKGROUND OF THE INVENTION

The present invention relates to a waterproof zip closure and a method for manufacturing it and, more particularly, to a waterproof zip closure consisting of two rows of teeth, each joined by means of a zip closure tape. The rows of teeth are locked into each other or separated from each other by a slide. The zip closure is sealed when the zip closure is in a closed position.

Conventional zip closures consist of two rows of teeth that can be joined by zip closure tapes. It is also known to employ slide means for locking and separating rows of teeth from each other, and to form seals, as in European Patent EP 0 210 632 B1. However, conventional techniques, such as that disclosed in EP 0 210 632 B1, are cannot be changed to adapt to changes in elasticity, tightness, and handling ease.

German Patent DE 37 15 068 discloses a waterproof zip closure where the zip closure is led around a set of small teeth, abutting the tapes of both sides when placed in a closed position. Inexpensive and conventionally known types of zip closures (plastic spirals, for example) are not adapted for use with known sealing means because of their respective methods of manufacture. Thus, designs such as DE 37 15 068 are disadvantageous because of the manufacturing costs involved.

OBJECTS AND SUMMARY OF THE INVENTION

Accordingly, it is an object of the present invention to provide a waterproof zip closure and a method of manufacturing which overcome the drawbacks of the prior art.

It is a further object of the invention to provide a waterproof zip closure easily fashioned from inexpensive and common types of zip closures, and to disclose a technique for manufacturing the zip closures.

It is still a further object of the invention to provide a method of manufacturing a waterproof zip closure with a plurality of potential values for elasticity, tightness, and slideablity (slide resistance) depending on the mode of application.

The method according to the present invention, overcomes the longstanding problems of the prior art by utilizing prestressing means which allow for sealing the zip closure with rubber or plastic that remains homogeneously conjoined.

The present invention uses a plastic material over the tapes to provide sealing. The plastic material is preferably a thermoplastic elastomer. Polyurethane is preferred due to its strong adhesive qualities, high elasticity and high abrasion resistance.

Preferred materials such as polyurethane permit further processing such as, for example, spraying with an additional material or welding additional end pieces. Zip closures manufactured in this way are readily attachable to items of clothing, or other substrates means including bags, and especially those made from, or coated with, PVC or polyurethane.

The present invention solves problems of waterproofing conventional zip closures using bulk quantities of inexpensive starting materials, inter alia. All known zip closures may be waterproofed according to the teachings of the present invention. It is particularly advantageous to employ simple plastic spiral zip closures, due to the ease of their combination with elastic, thermoplastic material and polyurethane as taught by the present invention. The inherent elasticity of elastic, thermoplastic material and polyurethane enables the present invention to lower manufacturing costs according to the methods taught.

According to a preferred embodiment, the method of manufacturing a waterproof zip closure according to the present invention includes the following steps: first a zip closure, with zip closure tapes, is soaked and coated with a first thermoplastic material while the zip closure is in a closed state; next the zip closure is cooled, while the zip closure tapes are being pulled apart laterally by a force pressing matching ends of the teeth together in a predetermined manner, short of separation. This disposes the plastifying material on the tooth tips between the teeth and the prestressed zip closure. During this time the thermoplastic material between, and on, both rows of teeth remains homogeneously conjoined.

The zip closure is subsequently led over a wedge at a braking station, where it is continuously opened, passed over a knife disposed on the wedge, which cuts the thermoplastic material and finally led to a doffing station which removes excess thermoplastic material. The finished waterproof zip closure then is closed.

An alternate preferred embodiment of the present invention uses PTFE (polytetrafluoroethylene) for the plastic material of which the spirals are formed. PTFE is advantageous according to this preferred embodiment, because of its heat-resistant and wear-resistant properties. Additionally, repelling characteristics of PTFE are of particular importance, according to methods of the present invention, to prevent formation of an adhesive bond between the sealing means and the teeth of the zip closure.

Briefly stated, the present invention provides a waterproof zip closure formed by extruding a thermoplastic thermoplastic material onto its teeth, and applying a transverse force while the thermoplastic material cures. The transverse force is sufficient to move the teeth in the separating direction, but is less than that which can cause separation. After curing of the thermoplastic material, the tapes and teeth of the zip closure are coated with a second thermoplastic sealing material, while the transverse force is maintained. When the transverse force is removed the sealing material is forced together to provide a waterproof seal. The sealing material on the tapes further improves the waterproof nature of the zip closure.

According to an embodiment of the invention, there is provided a method for the continuous manufacture of a waterproof zip closure comprising: pretreating a zip closure in a closed state with a first thermoplastic material, applying a lateral force to the zip closure while solidifying the thermoplastic material, the step of applying a lateral force including a applying sufficient lateral force to pull teeth of the zip closure a predetermined distance apart, separating and cutting the zip closure, applying a coating of a second thermoplastic sealing material to tapes and teeth of the zip closure, and closing the zip closure.

According to a feature of the invention, there is provided a method for the continuous manufacture of a waterproof zip closure which comprises the steps of: coating a closed zip closure with rubber, vulcanizing the rubber while applying a lateral force to the zip closure short of separation, the lateral force being sufficient to press matching tooth tips together on the inside, displacing the rubber on the tooth tips between the teeth and placing the zip closure under prestress, while the vulcanized rubber between rows of teeth remains homogeneously conjoined, opening the zip closure while transversely cutting the zip closure, doffing the zip closure, and closing the zip closure.

The above, and other objects, features and advantages of the present invention will become apparent from the following description read in conjunction with the accompanying drawing.

DETAILED DESCRIPTION OF THE PREFERRED EMBODIMENTS

Figure 1:
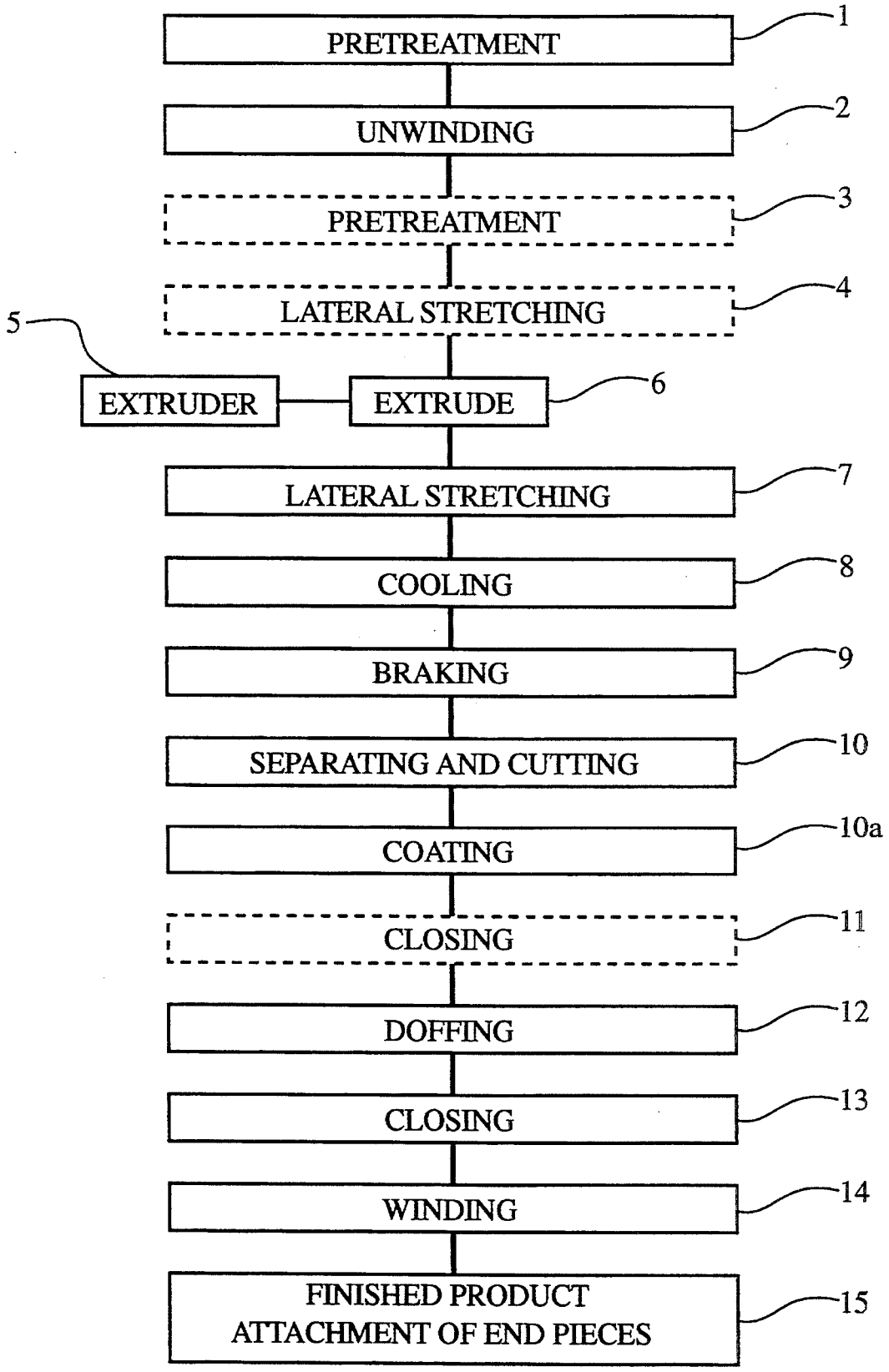
FIGURE 1 is a flow chart of a method for creating a preferred embodiment according to an embodiment of the present invention.

Referring now to FIGURE 1, the steps in a first embodiment of the method for producing a zip closure is shown in solid line. Alternate steps in a second embodiment of the method for producing a zip closure are shown in dashed lines. The optional nature of further steps of denoted by the use of all capital letters within the boxes, and through explanation in the text.

In step 1, a zip closure, including tapes with spirals sewn thereto, receives an optional initial pretreatment that includes treating the zip closure tapes with an adhesion promoting agent for the first thermoplastic material, and coating the tooth ends with an antistick agent. Then, in step 2, the zip closure tapes, with the adhesion promoting agent and the antistick agent included, is unwound from a conventional reel (now shown) on which it is wound.

In an alternate embodiment, pretreatment step 1, performed before unwinding step 2, is eliminated, and a pretreatment step 3 is performed after unwinding step 2.

In a further alternate embodiment, the part of pretreatment step 1 that includes coating the plastic spirals with the antistick agent may be performed before the plastic spirals are sewed to the zip closure tapes, and before the zip closure tapes, with plastic spirals sewn thereto, are wound on the reel from which they are unwound in step 2.

The pretreated and unwound zip closure is led in step 6 past an extruder step 6 in which the zip closure is soaked and coated with liquefied first thermoplastic material. Polyurethane is preferable for use as the liquified first thermoplastic material.

In step 7, the zip closure tapes are pulled apart laterally an amount sufficient to press together matching tooth tips, but not sufficiently to separate the matching tooth tips. This displaces the first thermoplastic material between the teeth at the tooth tips.

In step 8, the zip closure tape is cooled in, for example, a water bath.

In the alternate embodiment, lateral stretching step 4 is substituted for lateral stretching step 7. In this case, the first thermoplastic material is not displaced between by the lateral stretching action, since the first thermoplastic material is not present during lateral stretching step 4.

Lateral stretching step 4 or 7 may be performed by any convenient method. In the preferred embodiment, lateral stretching step 4 or 7 employs a pair of needle belts which diverge in the direction of travel of the zip closure. The divergence of the needle belts places an outward pulling force on the zip tape closure tapes to move the teeth the required distance. The needle belts may be driven or passive without departing from the spirit and scope of the invention.

When the thermoplastic material solidifies during cooling step 8, the solidified thermoplastic resin fixes the plastic teeth of the two rows at the positions established during lateral stretching step 4 or 7. The plastic teeth of the two rows of teeth remain under prestress in relation to each other when the zip closure leaves cooling step 8, and when the needle belts move out of engagement with the zip closure tapes.

After cooling step 8, a braking step 9 resists longitudinal motion. A subsequent separating and cutting step 10 applies a longitudinal stretching force to the zip closure exiting braking step 9, whereby longitudinal stretching of the zip closure tape is performed.

In separating and cutting step 10, a separating wedge separates a predetermined number of teeth (for example 1 to 8 teeth) by pulling apart the thermoplastic material retaining the teeth together.

Then, in separating and cutting step 10, a optional cut is made at the separated part of the zip closure to produce separate zip closures. The optional cut can be made by any convenient means such as, for example, a cutting knife which severs the zip closure tapes at the separated portion. Cutting the zip closure tapes at the separated portion enables cutting without damaging effective portions of the zip closure teeth. The cutting knife may be positioned at, or upstream of, the separating wedge.

At this same time, according to the present invention, the zip closure loses its lateral prestress. In step 10*a*, the zip closure tapes may optionally be coated a second thermoplastic material. The solidified thermoplastic material fills the area between the individual teeth.

A doffing step 12 follows coating step 10*a*.

In a closing step 13, following doffing step 12, a zip closure slide is fitted to close the zip closure. The zip closure slide engages the teeth of the facing zip closure elements. The interlaced rows of teeth press the plastic material together with a lateral tension to provide an integral seal.

In an alternate embodiment, a closing step 11 precedes doffing step 12. Closing step 13 is omitted in this embodiment.

The completed zip closure is wound on a reel in a winding step 14.

Either before or after winding step 14, in an end piece attachment step 15, end pieces are attached to the zip closures to produce a finished product.

The zip closure made according to the method of the present invention has sufficient thermoplastic elastic material between the individual teeth of its rows of teeth that the first thermoplastic material affixed between the facing rows of teeth is tightly pressed together when the zip closure is closed. This provides a waterproof seal. Additionally, since a second zip closure tape may likewise be coated with the thermoplastic material, this tape is also rendered waterproof. The resulting zip closure is thus an easily manufactured, and inexpensive product.

In one embodiment of the invention, material applied in the one or both of extruding step 6 and coating step 10 is a rubber material. In this embodiment, cooling step 8 is replaced with a vulcanizing step to vulcanize the rubber. A corresponding vulcanizing step (not shown) may be required following coating step 10*a*.

Having described preferred embodiments of the invention with reference to the accompanying figure, it is to be understood that the invention is not limited to those precise embodiments, and that various changes and modifications may be effected therein by one skilled in the art without departing from the scope or spirit of the invention as defined in the appended claims.

What is claimed is:

1. A method for the continuous manufacture of a waterproof zip closure comprising:

providing a zip closure having pairs of opposed plastic spiral teeth, with zip closure tapes;

pretreating said zip closure in a closed state with a first thermoplastic material;

applying a lateral force to said zip closure while solidifying said first thermoplastic material;

the step of applying a lateral force including applying a sufficient lateral force to urge corresponding teeth of said zip closure together, without separating both rows of teeth;

cooling said zip closure, while said first thermoplastic material solidifies;

separating said zip closure while applying a longitudinal force to said zip closure;

cutting said zip closure longitudinally; and, closing said zip closure.

2. Method according to claim 1, wherein said zip closure tapes are already pulled apart laterally, but not separated, prior to being coated with said first thermoplastic material, whereby respective teeth are pressed together to a defined degree.

3. Method according to claim 1, said step of pretreating further comprising:

treating zip closure tapes with an adhesion promoting agent.

4. Method according to claim 1, wherein said first thermoplastic material is polyurethane.

5. Method according to claim 1, wherein the step of closing said zip closure further includes:

applying a coating of a second thermoplastic material to tapes and teeth of said zip closure.

6. A method for the continuous manufacture of a waterproof zip closure comprising:

providing a zip closure having pairs of opposed plastic spiral teeth, with zip closure tapes;

soaking and coating said zip closure in a closed state with rubber;

applying a lateral force to said zip closure while vulcanizing said rubber;

the step of applying a lateral force further comprises applying a sufficient lateral force to urge corresponding teeth of said zip closure together without separating both rows of teeth; while, displacing said rubber on the tooth tips between said teeth and placing said zip closure under prestress, while said vulcanized rubber between both rows of teeth remains homogeneously conjoined;

leading said zip closure to a braking station;

separating said zip closure over a wedge having a knife which is cutting said vulcanized rubber;

leading said zip closure to a doting station; and, closing said finished zip closure.

* * * * *